United States Patent [19]

Buzhinsky et al.

[11] 4,110,862

[45] Sep. 5, 1978

[54] MACHINE FOR CLEANING OUTER SURFACE OF PIPES OF A MAINLINE

[76] Inventors: Vladimir Lukyanovich Buzhinsky, ulitsa Shafeeva 12/1, kv. 127; Konstantin Egorovich Raschepkin, ulitsa R. Zorge 37, kv. 67; Mikhail Grigorievich Dunjushkin, ulitsa R. Zorge 52/1, kv. 78; Gennady Tikhonovich Lysogorsky, prospekt Oktyabrya, 125, kv. 40; Rustem Ibragimovich Valeev, prospekt Oktyabrya 111/3, kv. 52; Yakov Arkadievich Nisenbaum, prospekt Oktyabrya 53, kv. 21; Deviz Faizrakhmanovich Ikhsanov, ulitsa Tsjurupy 110, kv. 77, all of Ufa, U.S.S.R.

[21] Appl. No.: 770,033

[22] Filed: Feb. 18, 1977

[30] Foreign Application Priority Data

Feb. 23, 1976 [SU] U.S.S.R. ..... 2331701

[51] Int. Cl.[2] ..... B08B 9/02

[52] U.S. Cl. ..... 15/88

[58] Field of Search ..... 15/88, 104.04

[56] References Cited

U.S. PATENT DOCUMENTS

| | | | |
|---|---|---|---|
| 2,436,099 | 2/1948 | Cummings | 15/88 |
| 2,635,270 | 4/1953 | Dawson | 15/104.04 |

*Primary Examiner*—Edward L. Roberts

*Attorney, Agent, or Firm*—Robert E. Burns; Emmanuel J. Lobato; Bruce L. Adams

[57] ABSTRACT

Apparatus mountable on a pipeline for cleaning the outer surfaces thereof having a self-propelled carriage for travelling axially on the pipeline. The carriage transports two annular casings that are hollow and within each is housed a chain rotor driven rotationally therein as the carriage travels axially on the pipeline. The casings and rotors each have an upper half-ring and a split lower half-ring. As the lower half rings of the casings are opened and closed the chain rotors are opened and closed and the pitch thereof is retained. The casings and rotors therein are constructed so that the split half-rings can be opened sufficiently to pass the pipeline between distal ends of the split rings for allowing mounting and dismounting of the carriage on the pipeline.

7 Claims, 11 Drawing Figures

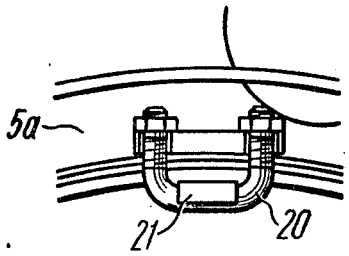
FIG. 9
FIG. 10
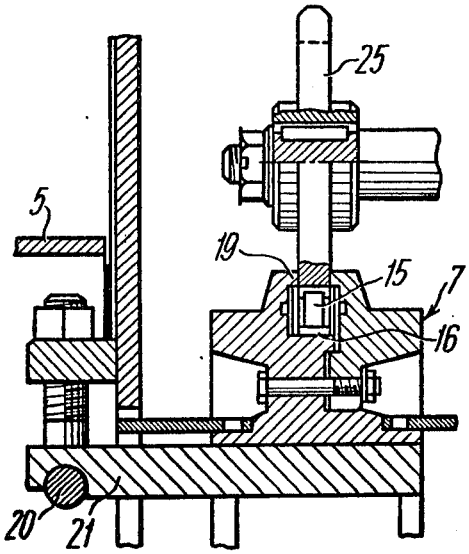

MACHINE FOR CLEANING OUTER SURFACE OF PIPES OF A MAINLINE

BACKGROUND OF THE INVENTION

The present invention relates to mechanisms for maintenance of mainlines, and more particularly to machines for cleaning outer surfaces of pipes of a mainline by removal old bitumen coating and dirt.

It is known that anticorrosive coating of operating pipelines degrades with time under the action of environmental factors (temperature difference, mechanical damages and the like). Pipe metal corrodes in the zones of degradation of anticorrosive coating so that even perforations of the pipe walls may occur, especially at the transversal welds of the pipeline due to unlike structure of the weld metal and the parent metal of the pipe, which is still more pronounced for underground pipelines under permanent action of soil electrolyte.

It will be apparent from the above that the repair of anticorrosive coating of the outer surface of a mainline should be done timely, especially because of the fact that the service life of anticorrosive coating is much shorter than that of the metal pipes.

It has been so far the world-wide practice to repair mainlines by replacing portions thereof by new ones. This is associated with temporary suspension of supply of a product being transported thus reducing the throughput capacity of the pipeline as a whole. Therefore, there is a long-felt need to resolve the problem of overhaul of anticorrosive coating of the outer surface of pipes in a mainline without interruption of supply of a product along the pipeline during the repair.

For that purpose there are provided machines for cleaning the outer surface of pipes of a mainline.

The invention may be most advantageously used for repair of operating mainlines of large diameter, in particular, oil and gas pipelines.

Known in the art are machines for cleaning outer surface of pipes of a mainline comprising a self-propelled carriage which is moved over the surface of a pipe being cleaned axially thereof during cleaning, and a working member mounted on the frame of the carriage which has a hollow annular casing accommodating an annular rotor coaxial with the pipe being cleaned which supports working tools.

Both casing and rotor of such machines are made detachable each consisting of two half-rings, one half-ring of the casing being the top half-ring rigidly fixed to the frame of the self-propelled carriage, and the other casing half-ring is the bottom half-ring.

In order to mount the machine on the operating pipeline, the bottom half-ring of the casing is first detached, then the rotor is withdrawn and dismantled into two half-rings. Subsequently the self-propelled carriage is installed with the top half-ring of the casing astride the pipeline, and the rotor is mounted on the pipeline then the rotor is aligned with the top half-ring of the casing, whereafter the bottom half-ring is mounted near the top half-ring, and their mating planes are attached to one another.

The machine is dismantled in the reverse order.

During repair of an underground pipeline, a trench is first excavated, then the pipeline is lifted at a height sufficient for the passage of the working member of the machine. The same result may be achieved by undermining the lower portion of the pipeline.

The main disadvantage of prior art machines for cleaning the outer surface of pipes consists in that the above-described operations of mounting and dismantling of the machine are require much time in view of a large number of labour-consuming steps involved so that the operation of the machine is unproductive and also unsafe for the operating staff.

In addition, heavy weight of detachable parts of the casing and rotor of the working member of the machine requires the employment of lifting gears which is very inconvenient, especially in trenches.

SUMMARY OF THE INVENTION

It is an object of the invention to provide a machine for cleaning outer surface of pipes of a mainline which enables reduction of time required for mounting and dismounting of the machine on an operating pipeline.

Another object of the invention is to lower labor requirements for above-mentioned operations.

Still another object of the invention is to improve labour conditions and safety of operating staff.

These and other objects are accomplished in a machine for cleaning the outer surface of pipes of a mainline having a self-propelled carriage moving over the pipe surface axially thereof during cleaning and having a frame mounting a working member which comprises a hollow casing accommodating an annular rotor which is coaxial with the pipe being cleaned and supports working tools. Both rotor and casing are made detachable each consisting of two half-rings. One half-ring of the casing is a top half-ring rigidly fixed to the frame of the self-propelled carriage, and the other half-ring of the casing is a bottom half-ring. According to the invention, the bottom half-ring of the casing and one of the rotor half-rings are made detachable each consisting of two hinged parts of substantially the same length. Each has one end articulated to the end of a respective half-ring for rotation relative thereto on either side of the axis of the pipe, whereby the distal ends of the hinged parts can be moved apart at the point of their detachment for mounting and dismounting of the machine on the pipe being cleaned. The top half-ring has a device for fastening the rotor thereto after bringing together the mating planes of the hinged parts of the casing and rotor.

This construction enables mounting and dismantling of the machine on a pipeline to be effected by moving apart the hinged parts of the casing and rotor without their removal thus reducing time and labour requirements for these operations, accordingly lifting gear or apparatus are only needed for installation of the machine on the pipeline and for its removal therefrom.

The provision of a device for fastening the non-detachable rotor half-ring, prior to the mounting, to the top half-ring of the working member casing enables simultaneous opening of the hinged parts of the casing thus further reducing time and labour requirements for mounting and dismantling of the machine.

The mating planes of the rotor at the points of location of the articulation joints connecting its half-ring to the hinged parts are preferably inclined, intersect one another on the detachment side and are displaced relative to the respective mating planes of the casing in the same direction by an amount of eccentricity which is selected in such a manner that the distal ends of the hinged parts of the rotor can be moved apart a distance equal to at least the diameter of the pipe being cleaned.

Inclination of the mating planes of the rotor at the points of its articulations enables the accommodation of the articulation joints within the rotor body so as to ensure its unobstructed rotation over guide rollers mounted in the casing, during cleaning.

In this case the displacement of the mating planes of the rotor relative to the respective mating planes of the casing provides for complete opening of the hinged parts of the rotor.

The rotor may comprise an annular cogwheel having driving pins received in an annular groove made in the outer surface of the half-ring and of the hinged parts of the cogwheel, and the axles of all driving pins are articulated to one another by means of links forming a roller chain having its ends fixed to the walls of the groove at the points of detachment of the hinged parts of the rotor so as to maintain the chain pitch.

The use of the cogwheel with a roller chain drive considerably lowers the manufacturing cost of the rotor and of the machine as a whole, and also reduces the time needed for rotor repair which only consists in replacement of the roller chain or parts thereof.

Annular projections are preferably provided on the side walls of the annular groove on the side of the outer surface of the cogwheel for retaining the roller chain, and longitudinal openings are preferably provided at the points of location of articulations joints connecting the hinged parts to the half-ring, the openings being made in the half-ring, in the annular projections for the passage of the roller chain outside upon moving apart the hinged parts of the rotor.

The device for securing the rotor to the top half-ring of the casing may comprise a removable clamp mounted to the half-ring and hook cooperating there with which is cantilevered to the inner surface of the rotor.

This construction of the device provides for holding the rotor within the top half-ring of the working member casing upon simultaneous movement apart of the hinged parts of the casing and rotor during mounting and dismantling of the machine on a pipeline.

BRIEF DESCRIPTION OF THE DRAWINGS

The invention will not be described in details with reference to a specific embodiment thereof illustrated in the accompanying drawing, in which:

FIG. 9 is a fragmentary view on an enlarged scale of detail "F" in FIG. 2;

FIG. 10 is an enlarged sectional view taken along section line X—X in FIG. 2;

DESCRIPTION OF THE PREFERRED EMBODIMENTS

Figure 1:
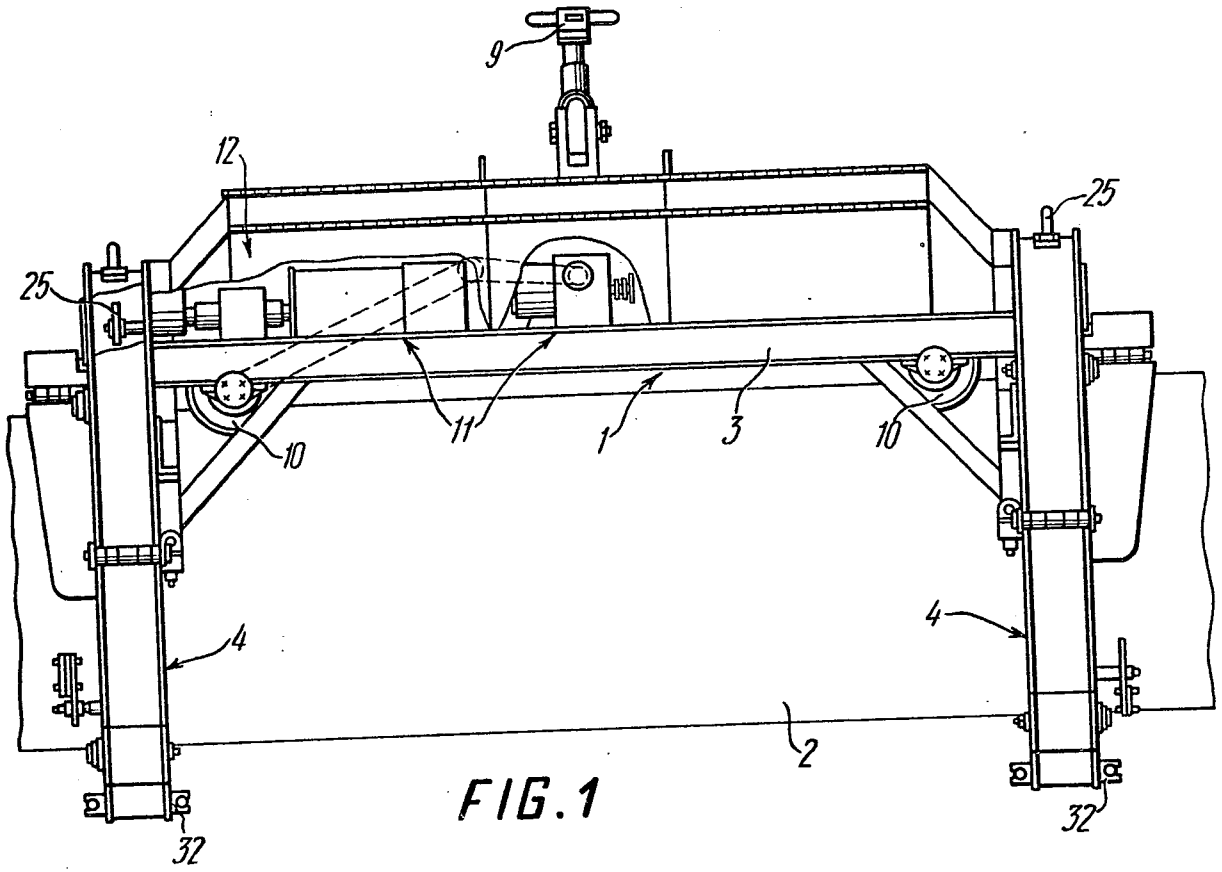
FIG. 1 is a side elevation, partially in section, illustrating a general view of the machine for cleaning the outer surface of a mainline according to the invention, in the operative position.

The machine for cleaning outer surface of pipes of a mainline comprises a self-propelled carriage 1 (FIG. 1) which is moved, during cleaning, over the surface of a pipe 2 being cleaned axially thereof. A frame 3 of the self-propelled carriage 1 supports, at the ends thereof, two working members 4.

Figure 2:
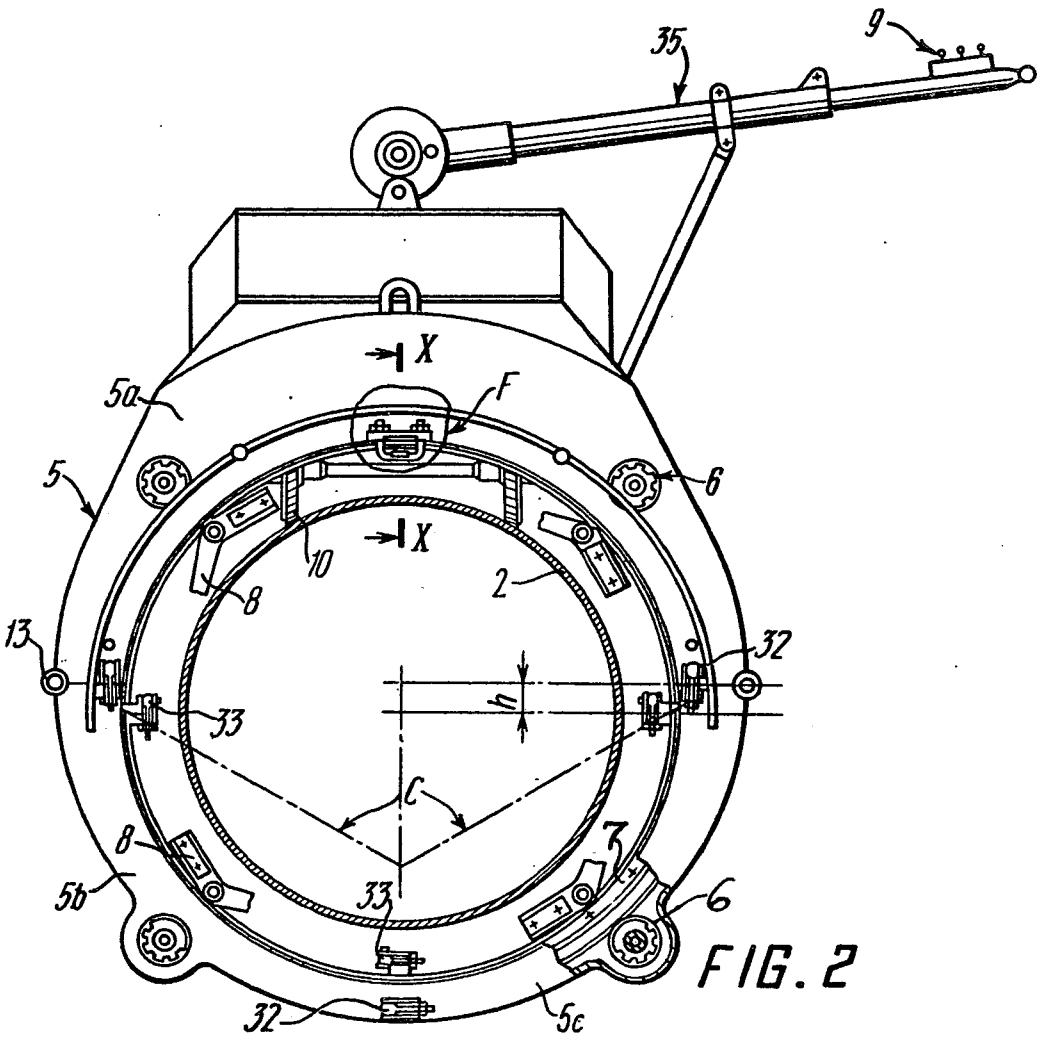
FIG. 2 is a front elevation of the same machine.

Each working member 4 has a hollow annular casing 5 (FIG. 2) accommodating an annular rotor 7 coaxial with the pipe 2 being cleaned and supported by support rollers 6 mounted to the casing. Each rotor carries replaceable cleaning tools 8.

The machine has a remote control board 9 mounted to the frame 3 of the self-propelled carriage 1.

The self-propelled carriage 1 has the frame 3 mounted on two pairs of wheels 10 which are designed for displacement of the carriage 1 over the surface of the pipe 2 being cleaned axially thereof.

The frame 3 of the self-propelled carriage 1 also supports a drive 11 for driving the wheels 10 and independently drives 12 for driving the rotors 7 of the working members 4.

In order to reduce reaction torques developed during rotation of the rotors 7, the rotors are driven in opposite directions.

Figures 3, 4:
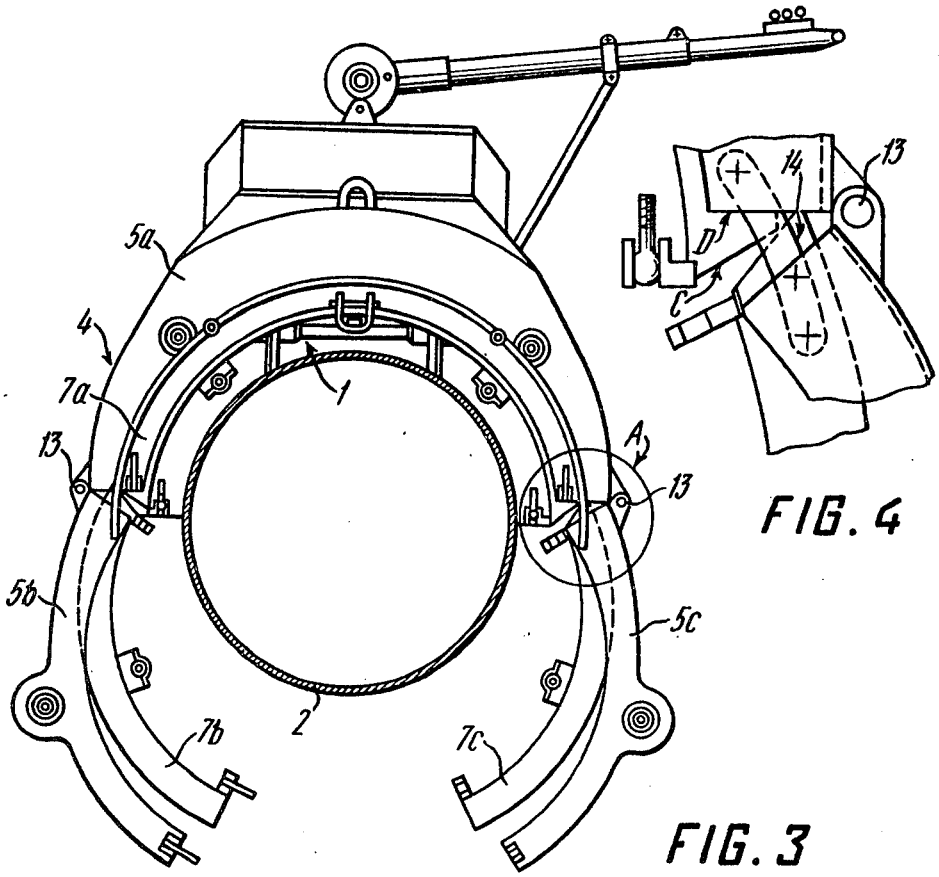
FIG. 3 is a side elevation view illustrating the machine of FIG. 2 during mounting/dismantling operations.
FIG. 4 is a fragmentary enlarged detail "A" of FIG. 3.

The casing 5 and the rotor 7 of each working member 4 are made detachable, each consisting of two half-rings, and one half-ring 5*a* of the casing 5 is the top half-ring rigidly fixed to the frame 3 of the self-propelled carriage 1. According to the invention, the bottom half-ring of the casing 5 and one of the half-rings of the rotor 7 are made detachable each consisting of two hinged parts 5*b* and 5*c* of the casing 5 and 7*b* and 7*c* of the rotor 7, respectively, of substantially the same length (FIG. 3).

Each of the hinged parts 5*b*, 5*c* and 7*b*, 7*c* have one end connected to the end of respective half-ring 5*a* and 7*a* by means of articulation joints 13 and 14 (FIG. 4) for rotation relative to these half-rings 5*a* and 7*a* on either side of the axis of the pipe 2 being cleaned, whereby the distal ends of the hinged parts 5*b* and 5*c*, 7*b* and 7*c* can be moved apart at the point of their detachment for mounting and dismantling the machine on an operating pipeline.

Figure 5:
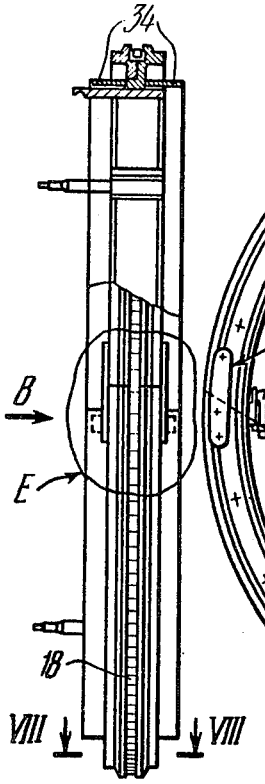
FIG. 5 is an enlarged side elevation view of a rotor working member.
Figure 8:
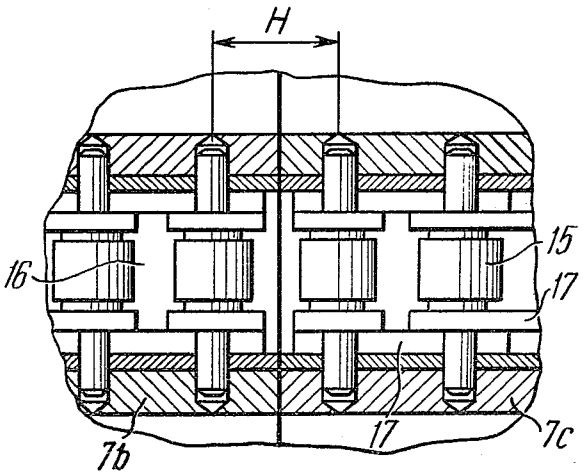
FIG. 8 is an enlarged sectional view taken along section line VIII—VIII in FIG. 5.
Figure 7:
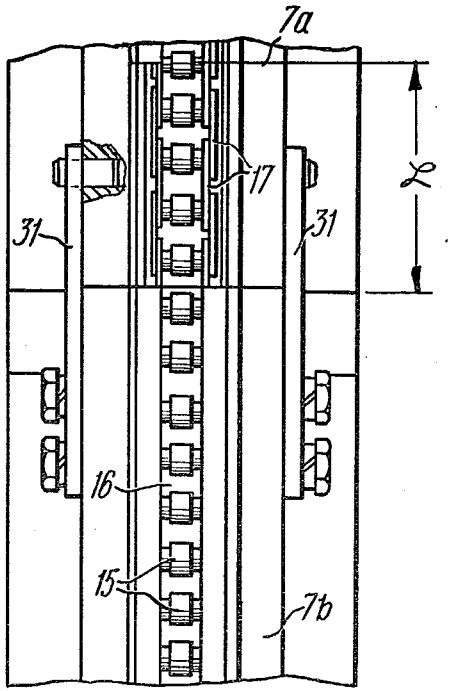
FIG. 7 is a fragmentary view on an enlarged scale of detail "E" in FIG. 5.

In this embodiment, the rotor 7 comprises a cogwheel having driving pins 15 (FIG. 7) received in an annular groove 16 made in the outer surface of the half-ring 7 and of the hinged parts 7*b* and 7*c* of the cogwheel, the axles of all driving pins 15 are connected to one another by means of links 17 forming a roller chain 18 (FIG. 5). The ends of the chain are fixed to the walls of the annular groove 16 of the rotor 7 at the points of detachment of the hinged parts 7*b* and 7*c* thereof so as to maintain the pitch "H" of the roller chain 18 as shown in FIG. 8.

The side walls of the annular groove 16 are provided, on the side of the outer surface of the cogwheel 7, with annular projections 19 (FIG. 10) for retaining the roller chain 18 within the groove 16 while no such projections 19 are provided at the points of location of the articulation joints 14 connecting the hinged parts 7*b* and 7*c* to the half-ring 7*a* in portions L (FIG. 7) of said half-ring 7.

In order to hold the rotor 7 within the casing 5 of the working member 4 during mounting and dismantling of the machine on the pipe 2 being cleaned, there is provided a device comprising a removable clamp 20 (FIG.

9) mounted on the top half-ring 5*a* of the casing 5 and a hook 21 cooperating therewith which is cantilevered to the inner surface of the rotor 7.

Figure 11:
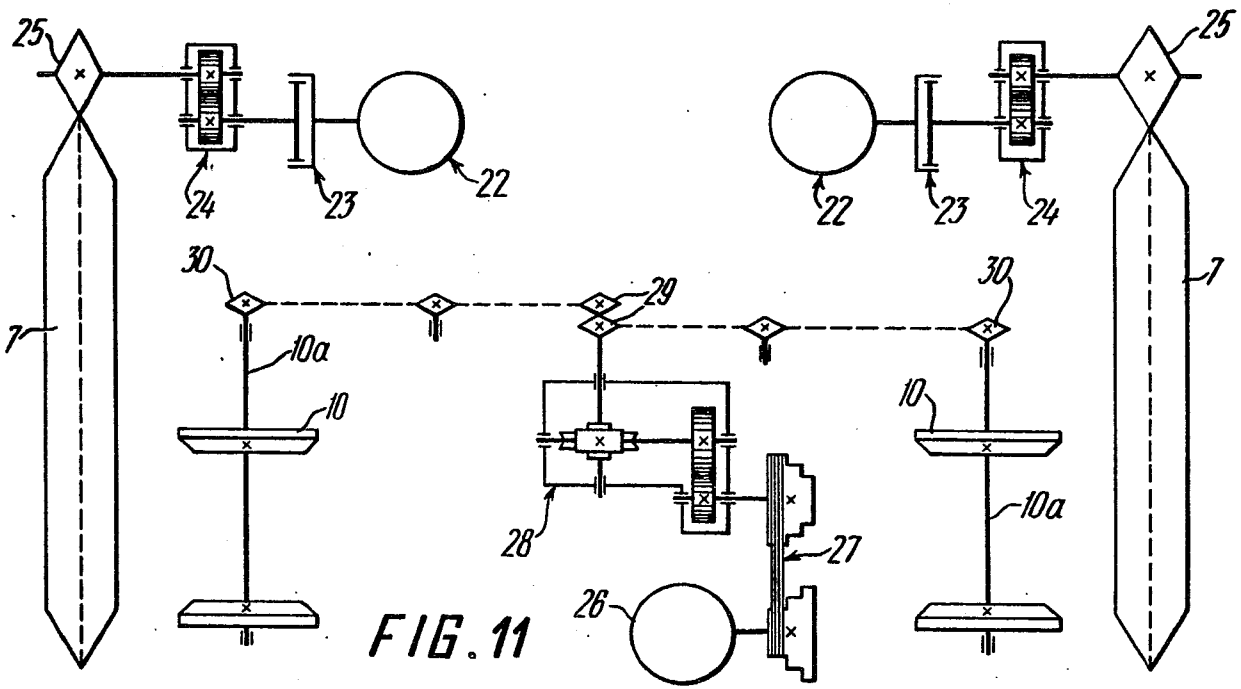
FIG. 11 is a functional diagram of the machine.

The independent drive 12 (FIG. 1) of each rotor 7 has an electric motor 22 (FIG. 11), a centrifugal clutch 23 and a transmission gear having an output shaft with a sprocket 25 (FIGS. 10, 11) cooperating with the driving pins 15 of the rotor 7.

The drive 11 (FIG. 1) of the wheels 10 of the self-propelled carriage 1 comprises an electric motor 26 (FIG. 11) having an output shaft which transmits rotary motion, via a belt transmission 27 and a transmission gear 28, to driving sprockets 29 of chain transmissions having driven sprockets 30 mounted on axles 10*a* of pairs of the wheels 10 of the self-propelled carriage 1.

According to the invention, the mating planes "C" of the rotor 7 (FIGS. 2, 4) at the points of location of the articulation joints 14 connecting the half-ring 7*a* of the rotor to the hinged parts 7*b* and 7*c* are symmetrically inclined, intersect one another on the side of their detachment and are displaced relative to respective mating planes "D" (FIG. 4) of detachment of the casing 5 in the same direction by the amount of eccentricity "*h*". The amount of eccentricity "*h*" is selected in such a manner that the hinged parts 7*b* and 7*c* of the rotor 7 can be moved apart at a distance at least equal to the diameter of the pipe 2 being cleaned.

Figure 6:
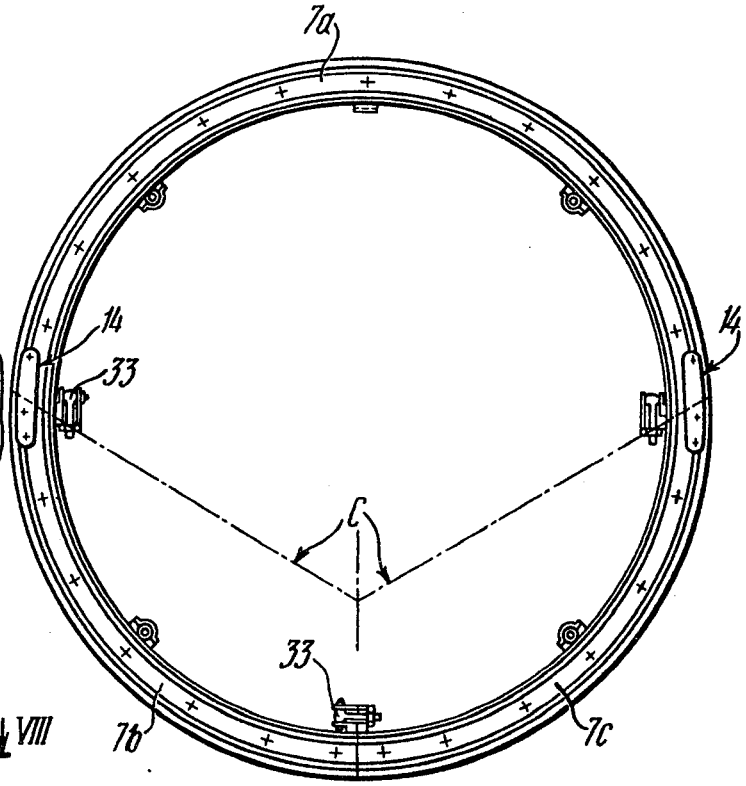
FIG. 6 is a side elevation view taken along arrow "B" in FIG. 5.

The articulation joint 14 connecting each hinged part 7*b*, 7*c* to the half-ring 7*a* of the rotor 7 (FIG. 6) comprises two plates 31 (FIG. 7) embracing the points of detachment, one end of each plate being rigidly secured to respective hinged part 7*b*, 7*c* and the other ends of the plates are articulated to the half-ring 7*a* of the rotor 7.

The points of detachment of the casing 5 and rotor 7 are interconnected by means of threaded joints 32 (FIG. 2) and 33, respectively, with hinged bolts, the bolts being disposed in pairs outside the casing 5 and inside the rotor 7.

Protective shields 34 (FIG. 5) are fixed to the outer surface of the rotor 7 at both ends thereof to prevent the cleaning wastes from penetrating the inner space of the casing 5.

The remote control board 9 (FIGS. 1, 2) of the machine is mounted on the frame 3 of the self-propelled carriage 1 by means of a telescopic bar 35.

The machine is mounted on the pipe 2 of an operating mainline being cleaned in the following manner.

In the initial position of the machine, the rotor 7 of the working member 4 is fixed to the half-ring 5*a* of the casing 5 by means of the hook 21 and removable clamp 20 so as to prevent the rotor 7 from falling out upon moving apart the hinged parts 5*b* and 5*c* of the casing 5. The detachment points of the casing 5 and rotor 7 are interconnected by means of the threaded joints 32 and 33.

Before mounting the machine on an underground pipeline, a trench is excavated, and the outer surface of the pipe 2 being cleaned is cleaned on the portion of installation of the machine. Then all threaded joints 32 and 33 are disassembled, and the machine is mounted, by means of a lifting gear, with the wheels 10 of the self-propelled carriage 1 resting against the pipe 2 being cleaned.

At the same time, the hinged parts 5*b* and 5*c* of the casing 5 and the hinged parts 7*b* and 7*c* of the rotor 7 are moved apart by rotating them about the articulation joints 13 and 14, respectively, in opposite directions.

Subsequently, the hinged parts 7*b* and 7*c* of the rotor 7 are connected to each other and to the half-ring 7*a* by means of the threaded joints 33, the hinged parts 5*b* and 5*c* of the casing 5 are connected to the top half-ring thereof by means of the threaded joints 32, and the removable clamp 20 is then removed.

The rotor 7 is aligned with the axis of the pipe 2 being cleaned by displacing the wheels 10 along their axles, whereafter the machine is ready for operation.

The machine for cleaning the outer surface of pipes of a mainline operates in the following manner.

First, the drives 12 of the rotors 7 are put on from the remote control board 9, and rotary motion is transmitted from the output shaft of each electric motor 22, via the centrifugal clutch 23, transmission gear 24 and the sprocket 25, to the rotor 7 supporting the cleaning tools 8.

Then the drive 11 of the wheels 10 of the self-propelled carriage 1 is put on. Rotary motion is transmitted from the output shaft of the electric motor 26, via the belt transmission 27 and the transmission gear 28, to the driving sprockets 29 and therefrom—to the driven sprockets 30 and axles 10*a* of the pairs of wheels 10 so that the machine is moved over the outer surface of the pipe 2 being cleaned axially thereof.

As a result of progressive movement of the self-propelled carriage 1 and rotation of the rotors 7, the cleaning tools 8 clean the outer surface of the pipe 2.

The machine is removed from the pipe in the reverse order of the mounting order.

What is claimed is:

1. Apparatus mountable on a pipeline for cleaning the outer surfaces of the pipeline comprising, a self-propelled carriage mountable on a pipeline having means for travelling axially on the pipeline for cleaning outer surfaces thereof, at least one hollow annular casing fixed to said carriage for travelling with said carriage axially of said pipeline, said casing comprising an upper half-ring connected to the carriage and a split, lower half-ring made of two parts each pivotally connected to the upper half-ring and having distal ends operable to a spaced apart position constituting an open position for accepting the pipeline therebetween when mounting the carriage on the pipeline and when dismounting the carriage and operable to a closed position enclosing the pipeline circumferentially, a rotor disposed in said casing for travelling therein circumferentially of the pipeline when the casing lower-ring is closed, said rotor including two half-rings, one of said rotor half-rings having distal ends operable to an open position with said casing lower half-ring and to a corresponding closed position, means for driving the rotor rotationally in said casing as said carriage travels axially of said pipeline, and said rotor having means for mounting cleaning tools angularly spaced thereon extending outwardly of said casing for engaging and cleaning the pipeline as said rotor travels circumferentially of said pipeline.

2. Apparatus mountable on a pipeline for cleaning the outer surfaces of the pipeline according to claim 1, in which said casing comprises an annular internal groove, and in which said rotor comprises a chain riding in said groove.

3. Apparatus mountable on a pipeline for cleaning the outer surfaces of the pipeline according to claim 2, in which said rotor chain comprises driving pins and links articulating the pins to one another.

4. Apparatus mountable on a pipeline for cleaning the outer surfaces according to claim 3, including means for retaining the pitch of said rotor chain when the casing and rotor chain are in an open condition.

5. Apparatus mountable on a pipeline for cleaning the outer surfaces of the pipeline according to claim 4, including means for securing the rotor to the top half-ring of said casing when the casing and rotor are in said closed condition.

6. Apparatus mountable on a pipeline for cleaning the outer surfaces of the pipeline according to claim 1, including a plurality of cleaning tools connected to said means on said rotor for mounting the cleaning tools.

7. Apparatus mountable on a pipeline for cleaning the outer surfaces of the pipeline according to claim 1, in which the split half-rings of the casing and rotor are split along a common plane.

* * * * *